US007126572B2

(12) United States Patent
Koga et al.

(10) Patent No.: US 7,126,572 B2
(45) Date of Patent: Oct. 24, 2006

(54) IMAGE DISPLAY METHOD AND IMAGE DISPLAY DEVICE

(75) Inventors: Koichi Koga, Tokyo (JP); Noboru Okuzono, Tokyo (JP); Machihiko Yamaguchi, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 333 days.

(21) Appl. No.: 10/396,329

(22) Filed: Mar. 26, 2003

(65) Prior Publication Data

US 2003/0184569 A1 Oct. 2, 2003

(30) Foreign Application Priority Data

Mar. 28, 2002 (JP) ..... 2002-090416

(51) Int. Cl.
*G09G 3/36* (2006.01)
*G09G 5/10* (2006.01)

(52) U.S. Cl. ..... 345/89; 345/600; 345/690; 345/99

(58) Field of Classification Search ..... 345/88–100, 345/204–205, 690–692, 55, 600
See application file for complete search history.

(56) References Cited

U.S. PATENT DOCUMENTS 6,459,416 B1 * 10/2002 Sasaki et al. ..... 345/89
6,753,854 B1 * 6/2004 Koyama et al. ..... 345/690
6,897,884 B1 * 5/2005 Tsuge et al. ..... 345/690
2003/0048238 A1 * 3/2003 Tsuge et al. ..... 345/55
2003/0137478 A1 * 7/2003 Naganuma ..... 345/89
2005/0007331 A1 * 1/2005 Yamazaki et al. ..... 345/92

FOREIGN PATENT DOCUMENTS

JP 2001-34232 2/2001

* cited by examiner

*Primary Examiner*—Bipin Shalwala
*Assistant Examiner*—David L. Lewis
(74) *Attorney, Agent, or Firm*—McGinn IP Law Group, PLLC

(57) ABSTRACT

A display panel 13 having a plurality of pixels 14 each divided into P (P=3) sub-pixels 15*a*, 15*b* and 15*c*, and a source driver 12 for driving each pixel 14 in accordance with three J (=8)-bit data values corresponding to the sub-pixels 15*a*, 15*b*, and 15*c*, and a signal processing circuit 12 for distributing K(=12)-bit (K>J) input image data as M (M=6) time-shared frame data values and supplying the frame data values to the source driver 12 are arranged. $2^{K-J}$ (=16) gray levels insufficient due to the difference between the numbers of bits of K-bit input image data and J-bit driving signals of the source driver 12 is realized by combinations of time-shared frame data of (P×M=18) ways performed for the sub-pixels 15*a*, 15*b*, and 15*c* in accordance with the M time-shared frame data values.

18 Claims, 18 Drawing Sheets

FIG. 3 PRIOR ART

| ORIGINAL DATA | R DATA | G DATA | B DATA |
|---|---|---|---|
| 0 | 0 | 0 | 0 |
| 1 | 0 | 0 | 1 |
| 2 | 1 | 1 | 2 |
| 3 | 2 | 2 | 3 |
| 4 | 3 | 3 | 4 |
| 5 | 4 | 4 | 5 |
| 6 | 5 | 5 | 6 |
| 7 | 6 | 6 | 7 |
| 8 | 7 | 7 | 8 |
| 9 | 8 | 8 | 9 |
| 10 | 9 | 9 | 10 |
| 11 | 9 | 9 | 11 |
| 12 | 10 | 10 | 12 |
| : | : | : | : |
| 509 | 458 | 458 | 509 |
| 510 | 459 | 459 | 510 |
| 511 | 459 | 459 | 511 |
| 512 | 460 | 460 | 512 |
| : | : | : | : |
| 1021 | 918 | 918 | 1021 |
| 1022 | 919 | 919 | 1022 |
| 1023 | 920 | 920 | 1023 |

FIG. 4 PRIOR ART

| RGB DATA | FRAME DATA | | | |
|---|---|---|---|---|
| | FIRST FRAME | SECOND FRAME | FIRST FRAME | SECOND FRAME |
| 0 | 0 | 0 | 0 | 0 |
| 1 | 1 | 0 | 0 | 0 |
| 2 | 1 | 0 | 1 | 0 |
| 3 | 1 | 1 | 1 | 0 |
| 4 | 1 | 1 | 1 | 1 |
| 5 | 2 | 1 | 1 | 1 |
| 6 | 2 | 1 | 2 | 1 |
| 7 | 2 | 2 | 2 | 1 |
| 8 | 2 | 2 | 2 | 2 |
| 9 | 3 | 2 | 2 | 2 |
| 10 | 3 | 2 | 3 | 2 |
| 11 | 3 | 3 | 3 | 2 |
| 12 | 3 | 3 | 3 | 2 |
| : | : | : | : | : |
| 508 | 127 | 127 | 127 | 127 |
| 509 | 128 | 127 | 127 | 127 |
| 510 | 128 | 127 | 128 | 127 |
| 511 | 128 | 128 | 128 | 127 |
| 512 | 128 | 128 | 128 | 128 |
| : | : | : | : | : |
| 1019 | 255 | 255 | 255 | 254 |
| 1020 | 255 | 255 | 255 | 255 |
| 1021 | 255 | 255 | 255 | 255 |
| 1022 | 255 | 255 | 255 | 255 |
| 1023 | 255 | 255 | 265 | 255 |

FIG. 7

| INPUT DATA TO CARRY SETTING CIRCUIT (D3~D0) | | | | OUTPUT DATA FROM CARRY SETTING CIRCUIT (Dp1~Dp3) | | | BRIGHTNESS EXPRESSION |
|---|---|---|---|---|---|---|---|
| D3 | D2 | D1 | D0 | Dp1 | Dp2 | Dp3 | |
| 1 | 1 | 1 | 1 | 6/6 | 6/6 | 5/6 | 17/18 |
| 1 | 1 | 1 | 0 | 6/6 | 5/6 | 5/6 | 16/18 |
| 1 | 1 | 0 | 1 | 5/6 | 5/6 | 5/6 | 15/18 |
| 1 | 1 | 0 | 0 | 5/6 | 5/6 | 4/6 | 14/18 |
| 1 | 0 | 1 | 1 | 5/6 | 4/6 | 4/6 | 13/18 |
| 1 | 0 | 1 | 0 | 4/6 | 4/6 | 4/6 | 12/18 |
| 1 | 0 | 0 | 0 | 4/6 | 4/6 | 3/6 | 11/18 |
| 1 | 0 | 0 | 0 | 4/6 | 3/6 | 3/6 | 10/18 |
| 0 | 1 | 1 | 1 | 3/6 | 3/6 | 3/6 | 9/18 |
| 0 | 1 | 1 | 0 | 3/6 | 3/6 | 2/6 | 8/18 |
| 0 | 1 | 0 | 1 | 3/6 | 2/6 | 2/6 | 7/18 |
| 0 | 1 | 0 | 0 | 2/6 | 2/6 | 2/6 | 6/18 |
| 0 | 0 | 1 | 1 | 2/6 | 2/6 | 1/6 | 5/18 |
| 0 | 0 | 1 | 0 | 2/6 | 1/6 | 1/6 | 4/18 |
| 0 | 0 | 0 | 1 | 1/6 | 1/6 | 1/6 | 3/18 |
| 0 | 0 | 0 | 0 | 0/6 | 0/6 | 0/6 | 0/18 |

* IN THE CASE OF A/B, FRAMES AMONG B FRAMES RESPECTIVELY OUTPUT "1" AND (B-A) FRAMES RESPECTIVELY OUTPUT "0"

FIG. 8

| TIME-SERIES PATTERN OF FRAME | OUTPUT DATA FROM CARRY SETTING CIRCUIT | | | | |
|---|---|---|---|---|---|
| | FRAME CYCLE (6 FRAMES) ←→ | FRAME CYCLE (6 FRAMES) ←→ | FRAME CYCLE (6 FRAMES) ←→ | FRAME CYCLE (6 FRAMES) ←→ | ··· |
| 6/6 | 111111 | 111111 | 111111 | 111111 | ··· |
| 5/6 | 111110 | 111110 | 111110 | 111110 | ··· |
| 4/6 | 110110 | 110110 | 110110 | 110110 | ··· |
| 3/6 | 101010 | 101010 | 101010 | 101010 | ··· |
| 2/6 | 100100 | 100100 | 100100 | 100100 | ··· |
| 1/6 | 100000 | 100000 | 100000 | 100000 | ··· |
| 0/6 | 000000 | 000000 | 000000 | 000000 | ··· |

FIG. 9

| INPUT DATA TO CARRY SETTING CIRCUIT (D3~D0) | | | | OUTPUT DATA FROM CARRY SETTING CIRCUIT (Dp1~Dp3) | | | BRIGHTNESS EXPRESSION |
|---|---|---|---|---|---|---|---|
| D3 | D2 | D1 | D0 | Dp1 | Dp2 | Dp3 | |
| 1 | 1 | 1 | 1 | 5/5 | 5/5 | 4/5 | 14/15 |
| 1 | 1 | 1 | 0 | 5/5 | 4/5 | 4/5 | 13/15 |
| 1 | 1 | 0 | 1 | 4/5 | 4/5 | 4/5 | 12/15 |
| 1 | 1 | 0 | 0 | 4/5 | 4/5 | 3/5 | 11/15 |
| 1 | 0 | 1 | 1 | 4/5 | 3/5 | 3/5 | 10/15 |
| 1 | 0 | 1 | 0 | 3/5 | 3/5 | 3/5 | 9/15 |
| 1 | 0 | 0 | 1 | 3/5 | 3/5 | 2/5 | 8/15 |
| 1 | 0 | 0 | 0 | 3/5 | 2/5 | 2/5 | 7/15 |
| 0 | 1 | 1 | 1 | 2/5 | 2/5 | 2/5 | 6/15 |
| 0 | 1 | 1 | 0 | 2/5 | 2/5 | 1/5 | 5/15 |
| 0 | 1 | 0 | 1 | 2/5 | 1/5 | 1/5 | 4/15 |
| 0 | 1 | 0 | 0 | 1/5 | 1/5 | 1/5 | 3/15 |
| 0 | 0 | 1 | 1 | 1/5 | 1/5 | 0/5 | 2/15 |
| 0 | 0 | 1 | 0 | 1/5 | 0/5 | 0/5 | 1/15 |
| 0 | 0 | 0 | 1 | 1/10 | 0/5 | 0/5 | (1/2)/15 |
| 0 | 0 | 0 | 0 | 0/5 | 0/5 | 0/5 | 0/15 |

* IN THE CASE OF A/B, A FRAMES AMONG B FRAMES RESPECTIVELY OUTPUT "1" AND (B-A) FRAMES RESPECTIVELY OUTPUT "0"

FIG. 10

| TIME-SERIES PATTERN OF FRAME | OUTPUT DATA FROM CARRY SETTING CIRCUIT | | | | |
|---|---|---|---|---|---|
| | FRAME CYCLE (5 FRAMES) ←→ | FRAME CYCLE (5 FRAMES) ←→ | FRAME CYCLE (5 FRAMES) ←→ | FRAME CYCLE (5 FRAMES) ←→ | ··· |
| 5/5 | 11111 | 11111 | 11111 | 11111 | ··· |
| 4/5 | 11110 | 11110 | 11110 | 11110 | ··· |
| 3/5 | 10101 | 10101 | 10101 | 10101 | ··· |
| 2/5 | 10100 | 10100 | 10100 | 10100 | ··· |
| 1/5 | 10000 | 10000 | 10000 | 10000 | ··· |
| 1/10 | 10000 | 00000 | 10000 | 00000 | ··· |
| 0/5 | 00000 | 00000 | 00000 | 00000 | ··· |

FIG. 13

| INPUT DATA TO CARRY SETTING CIRCUIT (D1,D0) | | OUTPUT DATA FROM CARRY SETTING CIRCUIT (Dp1~Dp3) | | | BRIGHTNESS EXPRESSION |
|---|---|---|---|---|---|
| D1 | D0 | Dp1 | Dp2 | Dp3 | |
| 1 | 1 | 2/2 | 2/2 | 0/2 | 4/6 |
| 1 | 0 | 2/2 | 0/2 | 0/2 | 2/6 |
| 0 | 1 | 1/2 | 0/2 | 0/2 | 1/6 |
| 0 | 0 | 0/2 | 0/2 | 0/2 | 0/6 |

* IN THE CASE OF A/B, A FRAMES AMONG B FRAMES RESPECTIVELY OUTPUT "1" AND (B-A) FRAMES RESPECTIVELY OUTPUT "0"

FIG. 14

| TIME-SERIES PATTERN OF FRAME | OUTPUT DATA FROM CARRY SETTING CIRCUIT | | | | |
|---|---|---|---|---|---|
| | FRAME CYCLE (2 FRAMES) ←→ | FRAME CYCLE (2 FRAMES) ←→ | FRAME CYCLE (2 FRAMES) ←→ | FRAME CYCLE (2 FRAMES) ←→ | ... |
| 2/2 | 11 | 11 | 11 | 11 | ... |
| 1/2 | 10 | 10 | 10 | 10 | ... |
| 0/2 | 00 | 00 | 00 | 00 | ... |

FIG. 17

| INPUT DATA TO CARRY SETTING CIRCUIT (D1,D0) | | OUTPUT DATA FROM CARRY SETTING CIRCUIT (Dp4) |
|---|---|---|
| D1 | D0 | |
| 1 | 1 | 3/4 |
| 1 | 0 | 2/4 |
| 0 | 1 | 1/4 |
| 0 | 0 | 0/4 |

FIG. 18

| TIME-SERIES PATTERN OF FRAME | OUTPUT DATA FROM CARRY SETTING CIRCUIT | | | | |
|---|---|---|---|---|---|
| | FRAME CYCLE (4 FRAMES) ←→ | FRAME CYCLE (4 FRAMES) ←→ | FRAME CYCLE (4 FRAMES) ←→ | FRAME CYCLE (4 FRAMES) ←→ | ... |
| 3/4 | 1110 | 1110 | 1110 | 1110 | ... |
| 2/4 | 1010 | 1010 | 1010 | 1010 | ... |
| 1/4 | 1000 | 1000 | 1000 | 1000 | ... |
| 0/4 | 0000 | 0000 | 0000 | 0000 | ... |

FIG. 19

| LOW-ORDER 4BIT IMAGE DATA | | | | D3 ↓ | ↓ | D2 ↓ | D1,D0 ↓ | BRIGHTNESS EXPRESSION |
|---|---|---|---|---|---|---|---|---|
| D3 | D2 | D1 | D0 | Dp1 | Dp2 | Dp3 | Dp4 | |
| 1 | 1 | 1 | 1 | 1 | 1 | 1 | 3/4 | 15/16 |
| 1 | 1 | 1 | 0 | 1 | 1 | 1 | 2/4 | 14/16 |
| 1 | 1 | 0 | 1 | 1 | 1 | 1 | 1/4 | 13/16 |
| 1 | 1 | 0 | 0 | 1 | 1 | 1 | 0/4 | 12/16 |
| 1 | 0 | 1 | 1 | 1 | 1 | 0 | 3/4 | 11/16 |
| 1 | 0 | 1 | 0 | 1 | 1 | 0 | 2/4 | 10/16 |
| 1 | 0 | 0 | 1 | 1 | 1 | 0 | 1/4 | 9/16 |
| 1 | 0 | 0 | 0 | 1 | 1 | 0 | 0/4 | 8/16 |
| 0 | 1 | 1 | 1 | 0 | 0 | 1 | 3/4 | 7/16 |
| 0 | 1 | 1 | 0 | 0 | 0 | 1 | 2/4 | 6/16 |
| 0 | 1 | 0 | 1 | 0 | 0 | 1 | 1/4 | 5/16 |
| 0 | 1 | 0 | 0 | 0 | 0 | 1 | 0/4 | 4/16 |
| 0 | 0 | 1 | 1 | 0 | 0 | 0 | 3/4 | 3/16 |
| 0 | 0 | 1 | 0 | 0 | 0 | 0 | 2/4 | 2/16 |
| 0 | 0 | 0 | 1 | 0 | 0 | 0 | 1/4 | 1/16 |
| 0 | 0 | 0 | 0 | 0 | 0 | 0 | 0/4 | 0/16 |

IMAGE DISPLAY METHOD AND IMAGE DISPLAY DEVICE

BACKGROUND OF THE INVENTION

1. Field of the Invention

The present invention relates to an image display device for performing preferable halftone expression by eliminating flicker and image unevenness and a display method of the halftone expression.

2. Discussion of the Related Art

A liquid crystal display (LCD) device and a plasma display device have been recently noticed as power-saving, slim and lightweight image display devices. In case of these display devices, image display is normally performed by a direct driving system in accordance with a digital image signal. Moreover, to display a halftone monochromatic image other than white and black or a color image in accordance with three primary colors of red (R), green (G) and blue (B), gray level display referred to as "halftone expression" is necessary. Therefore, the number of gray levels is decided by the number of bits of an image signal to be used and the necessary number of bits of the image signal increases as the number of gray levels increases.

For example, in case of a LCD device, it is difficult to express more than 256 ($=2^8$) gray levels because a source driver commonly used only having 8-bit. To display more gray levels, it is necessary to develop and use such as a 12-bit source driver. In this case, however, because a circuit size increases compared to an 8-bit source driver, a problem occurs that the cost of the source driver increases.

Therefore, to express more gray levels without increasing the number of bits which can be processed by a source driver, a method called "Frame-Rate-Control (FRC) method" is proposed. The FRC method sets the number of bits supplied to the source driver to a value equal to or less than the number of bits of an input image data and applies the frame-thinning control corresponding to an insufficient number of bits for an insufficient number of gray levels. For example, 10-bit input image data is divided into four 8-bit frame data. And these frame data is supplied sequentially to an 8-bit source driver to display gray levels for 10 bits using the 8-bit source driver.

However, the FRC method has a problem that it is difficult to increase the number of frames (thinning number of frames) displayed by one input data because flicker or uneven image occurs. To solve this problem, an "error-diffusion frame-thinning system" is proposed in which the difference between voltage of a gray level to be displayed on a certain pixel and the voltage of the nearest gray level which can be displayed predetermined hardware is regarded as an "error" and the error is reflected (diffused) on the voltage of gray level of pixels present around the pixel.

As one of FRC gray level methods for achieving increase of display gray levels above described, there is the "PICTURE DISPLAY METHOD AND PICTURE DISPLAY DEVICE USED FOR THE METHOD" (Japanese Patent Laid-Open No. 2001-34232). The above method and device are an image display method and device for displaying a monochromatic image having a gray level resolution larger than the reproducing capacity of R, G and B of a color display panel in which a unit pixel is constituted by a combination of three pixels of R, G and B in accordance with the gray level expression corresponding to the input bits of the monochromatic image by using the FRC gray level method when displaying a monochromatic image by the color display panel.

FIG. 1 is a block diagram of a LCD device 100 disclosed in Japanese Patent Laid-Open No. 2001-34232. The LCD device 100 is provided with a color LCD 101 for displaying an image by liquid crystal, a backlight section 102 serving as a light source of the color LCD 101, a data processing section 104 for performing predetermined data processing, a source driver 103 for driving the color LCD 101, and an interface (I/F) 105 for capturing input image data into the data processing section 104.

FIGS. 2A and 2B are locally enlarged views of the color LCD 101. As shown in FIG. 2A, the display screen of the color LCD 101 is constituted so that R-pixel, G-pixel and B-pixel are horizontally lined up when using a color filter. That is, R-pixel, G-pixel and B-pixel are arranged in accordance with "stripe arrangement". Color display according to image data values of R, G and B is normally performed through the R-pixel, G-pixel and B-pixel. In the case of a conventional invention, a monochromatic image is displayed as described below.

As shown in FIG. 2B, the LCD device 100 uses R-pixel p1, G-pixel p2 and B-pixel p3 as an unit pixel p to display a monochromatic image. In this case, the unit pixel p is constituted by the R-pixel p1, G-pixel p2 and B-pixel p3 when using a color filter. Therefore, the set number of a brightness value which can be displayed by one unit pixel p becomes three times larger than the set number of the brightness value which can be displayed by each of the R-pixel p1, G-pixel p2 and B-pixel p3. That is, by setting the brightness range to 1/3, it is possible to increase the number of gray levels of a display image.

Then, as a specific example, the FRC performed by the data processing section 104 is described when 10-bit monochromatic-image data is supplied to the interface (I/F) 105 by assuming that R-pixel p1, G-pixel p2 and B-pixel p3 respectively perform 8-bit display by the 8-bit source driver 103.

In this case, because input image data is 10-bits and the data to be processed by the source driver 103 is 8-bits, the difference between the bits is equal to 2. Therefore, the number of frames in the frame cycle under the FRC becomes 4 ($=2^2$). Therefore, 8-bit image data values are successively displayed by each frame from first to fourth frames for each of the R-pixel p1, G-pixel p2 and B-pixel p3.

The data processing section 104 first divides 10-bit monochromatic-image data (original data) into R data, G data and B data. The above division is performed by referring to the conversion table shown in FIG. 3 (numerical notation in FIG. 3 uses decimal numbers). For example, when the original data is "0", then "0" is distributed to R data, G data and B data. When the original data is "10", then "9", "9" and "10" are distributed to R data, G data and B data respectively. Thus, 10-bit R data, G data and B data are generated from 10-bit monochromatic-image data (original data).

Then, because the R data, G data and B data thus generated are respectively 10 bits (1,024-gray level expression), they are distributed to 8-bit data (256-gray level expression) using four frames, that is, 8-bit "frame data". Dividing to the frame data is performed by referring to the conversion table shown in FIG. 4. The numerical notation in FIG. 4 also uses decimal numbers.

That is, 10-bit R data, G data, and B data (0–1023) are converted into 8-bit frame data (0–255) for each of first to fourth frames. The above mentioned corresponds to the fact of constituting one frame cycle by four frames generated in time series in the FRC gray level method. Moreover, the above mentioned corresponds to the fact of using 8-bit frame data included in each of four frames to display a group of 10-bit monochromatic-image data (original data) values by a pixel p. The R-pixel p1, G-pixel p2 and B-pixel p3 are driven in accordance with the frame data thus generated and an image constituted by the pixels p1 to p3 is displayed by the pixel p.

As described above, the conventional LCD device 100 for expressing halftones by using the FRC gray level method shown in FIGS. 1 to 4 makes it possible to express gray levels ($2^K$ gray levels) corresponding to K bits of input image data by a J-bit source driver which can express $2^J$ gray levels by setting the number of frames in one frame cycle on accordance with the difference N (=K−J) between the numbers of bits when displaying K-bit (K is positive integer of K>J) input image data by a J-bit (J is positive integer) source driver to $2^N$ and distributing K-bit input data to $2^N$ J-bit frame data values.

However, because the number of frames during a frame cycle of FRC is set to $2^N$, the frame cycle becomes extremely long as the difference N between the numbers of bits increases. As a result, flicker and image unevenness peculiar to the FRC gray level method are generated and the image quality is deteriorated instead.

The present invention is made in view of the above situation and its object is to provide an image display method and an image display device for expressing preferable halftones by using the FRC method and capable of preventing flicker and image unevenness.

It is another object of the present invention to provide an image display method and an image display device for expressing halftones by using the FRC method and capable of keeping the number of frames during a frame cycle at $2^N$ or less when the difference between the number of bits of input image data and the number of bits of a driver is equal to N.

Still other objects of the present invention not described in this specification will become more apparent from the following description and the accompanying drawings.

SUMMARY OF THE INVENTION

It is an object of the present invention to provide an image display device for displaying a preferable image and a display method for displaying the image.

Particularly, it is an object of the present invention to provide an image display device for performing preferable halftone expression by eliminating flicker and image unevenness and a display method of the halftone expression.

According to an aspect of the present invention, the present invention provides (1) an image display method for expressing gray levels in accordance with a frame-rate-control (FRC) method using a display device having a plurality of pixels consisting P (P is positive integer) sub-pixels, comprising the steps of:

supplying K-bit (K is positive integer) input image data to signal processing circuit;

generating M (M is positive integer) time-shared frame data in time series each having P J-bit (J is positive integer of J<K and $M<2^{K-J}$) data from K-bit input image data;

supplying said time-shared frame data to a source driver as the driving data;

wherein said signal processing circuit generates $2^{K-J}$ gray levels insufficient due to the difference between the numbers of bits of the K-bit input image data and the J-bit time-shared frame data by using at least some of combinations of said time-shared frame data of (P×M) ways performed for each of the pixels in accordance with the $2^{K-J}$ gray levels.

This invention also provides (2) a driver for display-driving the pixels of the display panel by constituting each of a plurality of pixels of a display panel by P (P is positive integer) sub-pixels and supplying P J-bit (J is positive integer) driving data values to the P sub-pixels. Moreover, the image display method comprises the steps of generating time-shared frame data including M (M is positive integer of $M<2^{K-J}$) frames arranged in accordance with time series each of which includes P J-bit data values from K-bit (K is positive integer of K>J) input image data values and supplies the time-shared data to the driver as the driving data.

$2^{K-J}$ gray levels insufficient due to the difference between the numbers of bits of the K-bit input image data and the J-bit driving data are generated by using at least some of combinations time-shared controls of (P×M) ways performed for each of the sub-pixels of the display panel in accordance with the time-shared frame data.

Therefore, it is possible to express gray levels ($2^K$ gray levels) corresponding to K bits of input image data by the J-bit driver ($2^J$-gray level expression). Moreover, because the number of frames in one frame cycle is M which is less than conventional $2^N$ (N=K−J), it is prevented that the frame cycle is lengthened as ever as the number-of-bit difference N increases and the image quality is deteriorated due to flicker or image unevenness peculiar to the FRC gray level method.

This invention also provides (3) a preferable image display method of the present invention generates P carry signals by generating M time-shared data values in accordance with time-shared every above sub-pixel in accordance with low-order (K−J) bit data of the K-bit input image data, adds the P carry signals to high-order J-bit data values of the input image data respectively, and uses the obtained addition results as the J-bit data for each of the above P sub-pixels.

Another preferable image display method of the present invention compensates an insufficient number of combinations of the time-shared frame data values to the P sub-pixels by using at least some of (Q×M) {Q is positive integer of $(Q\times M)<2^{K-J}$} time-shared frame data values when the total number of combinations of (P×M) ways of the time-shared frame data values is equal to ($P\times M<2^{K-J}$) which is less than $2^{K-J}$ gray levels.

For example, when one pixel is constituted by three sub-pixels to perform $2^4$=16 gray levels insufficient due to the number-of-bit difference N (N=K−J=4) in accordance with time-shared frame data combinations of 3×5=15 ways by supplying five time-shared frame data values to three sub-pixels, the number of combinations of time-shared frame data lacks a value equivalent to one gray level. In this case, by adding a group of 10 time-shared frame data different from Q (e.g. 2)×5=10 time-shared frame data values generated by repeating five time-shared data values Q (e.g. 2) times (that is, by doubling the frame cycle), it is possible to generate 16 gray levels to be insufficient in accordance with combinations of time-shared controls of 15+1=16 ways.

In this case, the frame cycle of the added one time-shared frame data value is doubled. However, because the probability for the gray levels to be displayed at the doubled framed cycle is 1/16, the influence can be almost ignored.

In the case of still another preferable image display method of the present invention, the above time-shared frame data is related so that combination display by the P sub-pixels shows maximum brightness or minimum brightness among the above $2^{K-J}$ gray level displays to the maximum or minimum value of low-order (K−J)-bit data of the input image data.

This invention also provides (4) an image display device for expressing halftones by using the FRC gray level method, which comprises:

a display panel having a plurality of pixels constituted by P (P is positive integer) sub-pixels;

a driver for display-driving each of the pixels of the display panel in accordance with P J-bit (J is positive integer) driving data values corresponding to the P sub-pixels; and a signal processing circuit for distributing K-bit (K is positive integer of K>J) input image data to time-shared frame data values including M (M is positive integer of $K<2^{K-J}$) frames arranged in time series each of which includes P J-bit data values and supplying the time-shared frame data values to the driver as the driving data, wherein said signal processing circuit generates $2^{K-J}$ gray levels insufficient due to the difference between the numbers of bits of the K-bit input image data and the J-bit time-shared frame data by using at least some of combinations of said time-shared frame data of (P×M) ways performed for each of the pixels in accordance with the $2^{K-J}$ gray levels.

(5) In the case of an image display device of the present invention, a plurality of pixels each of which is constituted by P (P is positive integer) sub-pixels are arranged on a display panel and each of the pixels is display-driven by a driver in accordance with P J-bit (J is positive integer) driving data values corresponding to P sub-pixels. Moreover, K-bit (K is positive integer of K>J) input image data is distributed to time-shared frame data including M (M is positive integer of $M<2^{K-J}$) frames arranged in time series each of which includes P J-bit data values and the time-shared frame data is supplied to the driver as the driving data. Thus, $2^{K-J}$ gray level displays insufficient due to the difference between the numbers of bits of the K-bit input image data and the J-bit driving data are generated by using at least some of combinations of time-shared controls of (P×M) ways performed for each of the sub-pixels in accordance with the time-shared frame data.

As a result, it is possible to express gray levels ($2^K$ gray levels) corresponding to K bits of input data b a J-bit driver ($2^J$ gray level expression) and the number of frames of one frame cycle is set to M which is less than conventional $2^N$. Therefore, it is prevented that the frame cycle is lengthened as ever as the number-of-bit difference (K−J=N) increases and thus, image quality is deteriorated due to flicker or image unevenness.

(6) In the case of a preferable image display device of the present invention, the signal processing circuit is constituted by a carry setting circuit for generating P carry signals by generating M time-series data values in time series for each of the above sub-pixels in accordance with the data for low-order (K−J) bits of the K-bit input image data and P adders for respectively adding these P carry signals to the data for high-order J bits of the input image data and outputting obtained addition results as J-bit data values to the P sub-pixels.

Another preferable image display device of the present invention compensates an insufficient number of combinations of the time-shared frame data values to the P sub-pixels by using at least some of (Q×M) {Q is positive integer of $(Q\times M)<2^{K-J}$} time-shared frame data values when the total number of combinations of (P×M) ways of the time-shared frame data values is equal to ($P\times M<2^{K-J}$) which is less than $2^{K-J}$ gray levels.

For example, when one pixel is constituted by three sub-pixels to perform $2^4=16$ gray levels insufficient due to the number-of-bit difference N=K−J=4 in accordance with time-shared control combinations of 3×5=15 ways by supplying five time-shared frame data values to three sub-pixels, the number of combinations of time-shared controls becomes insufficient by a value equivalent to one gray level. In this case, by adding a group of 10 time-shared data values different from Q (e.g. 2)×5=10 time-shared frame data values generated by repeating five time-shared data values Q (e.g. 2) times (that is, by doubling the frame cycle), it is possible to generate 16 gray levels to be insufficient in accordance with combinations of time-shared controls of 15+1=16 ways.

In this case, the frame cycle of the added one time-shared frame data value is doubled. However, because the probability for the gray levels to be displayed at the doubled framed cycle is 1/16, the influence can be almost ignored.

In the case of still another preferable image display device of the present invention, the above time-shared frame data is related so that combination display by the P sub-pixels shows maximum brightness or minimum brightness among the above $2^{K-J}$ gray level displays to the maximum or minimum value of low-order (K−J)-bit data of the input image data.

BRIEF DESCRIPTION OF THE DRAWINGS

This above-mentioned and other objects, features and advantages of this invention will become more apparent by reference to the following detailed description of the invention taken in conjunction with the accompanying drawings, wherein:

FIG. 3 is an illustration of a conversion table for distributing monochromatic image data of a conventional LCD device to R, G and B data;

FIG. 4 is an illustration of a conversion table for distributing RGB data of a conventional LCD device to frame data;

FIG. 7 is a functional illustration for explaining relations between inputs and outputs of a carry setting circuit in the first embodiment of the present invention;

FIG. 8 is an illustration showing the time transition of outputs (carry signals) of a carry setting circuit in the first embodiment of the present invention;

FIG. 9 is a functional illustration for explaining relations between inputs and outputs of a carry setting circuit in a second embodiment of the present invention;

FIG. 10 is an illustration showing the time transition of outputs (carry signals) of the carry setting circuit of the second embodiment of the present invention;

FIG. 13 is a functional illustration for explaining relations between inputs and outputs of the carry setting circuit of the third embodiment of the present invention;

FIG. 14 is an illustration showing the time transition of outputs (carry signals) of the carry setting circuit of the third embodiment of the present invention every frame cycle;

FIG. 17 is a functional illustration for explaining relations between inputs and outputs of a carry setting circuit of the fourth embodiment of the present invention;

FIG. 18 is an illustration showing the time transition of outputs (carry signals) of the carry setting circuit of the fourth embodiment of the present invention every frame cycle;

FIG. 19 is an illustration for explaining relations between data for low-order four bits of 12-bit input image data carry signals in the fourth embodiment of the present invention.

DETAILED DESCRIPTION OF THE PREFERRED EMBODIMENTS

Preferred embodiments of an image display method and an image display device of the present invention are described below in detail by referring to the accompanying drawings.

[First Embodiment]

Figure 1:
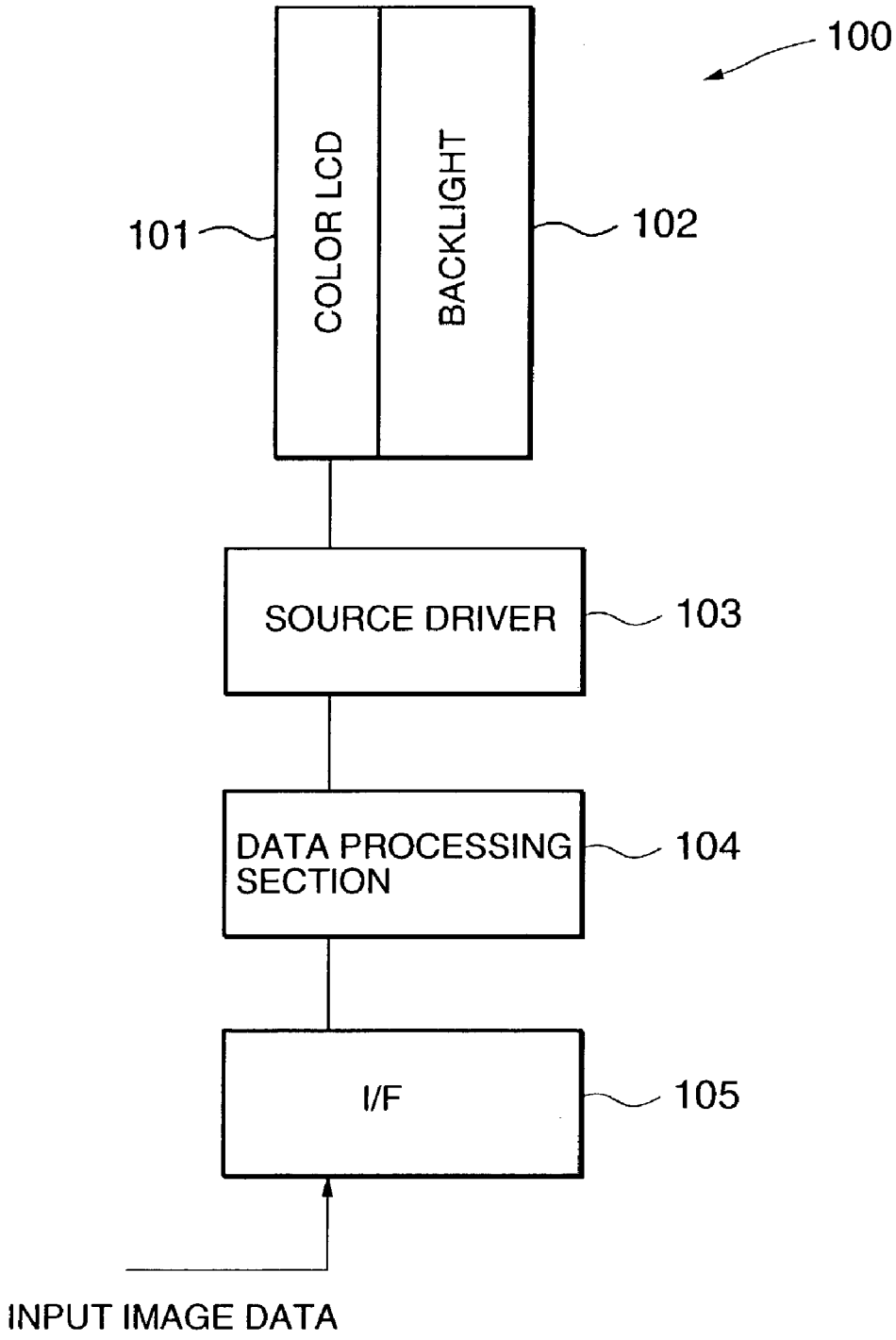
FIG. 1 PRIOR ART
FIG. 1 is a block diagram of a conventional LCD device.
Figure 2A:
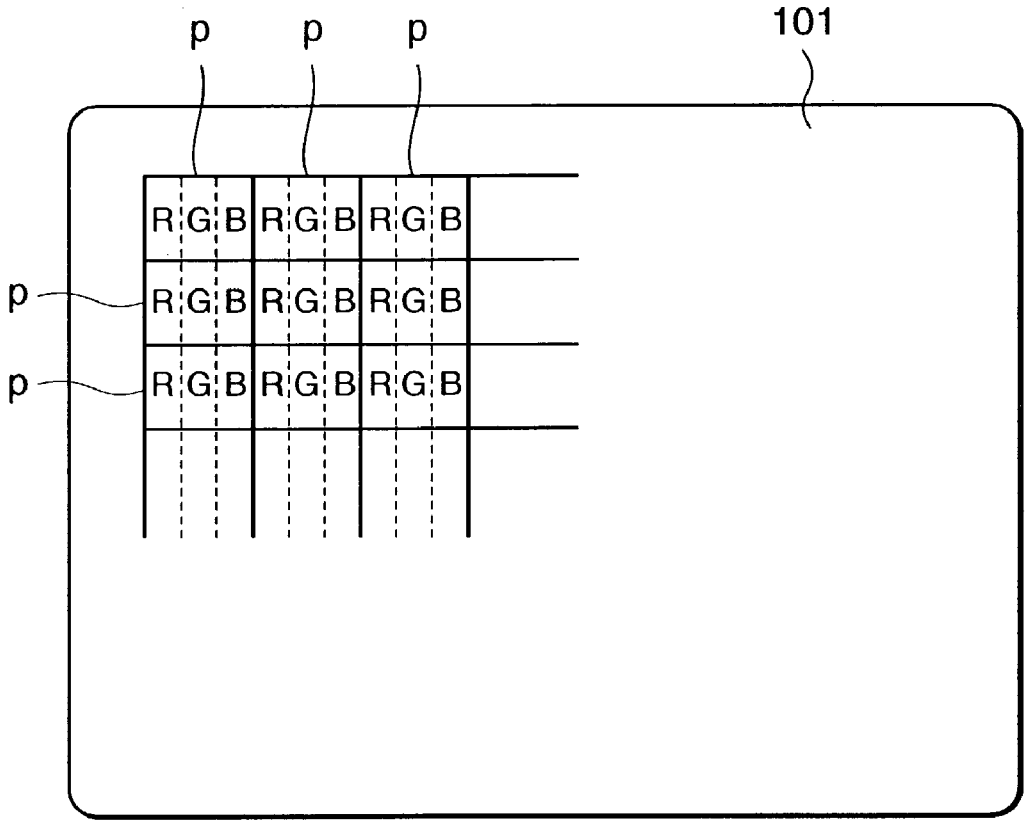
FIG. 2A PRIOR ART
FIGS. 2A and 2B are locally enlarged views of the color LCD panel of a conventional LCD device.
Figure 2B:
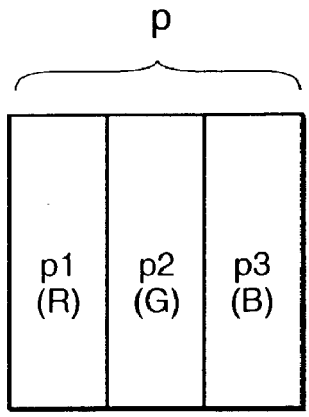
FIG. 2B PRIOR ART
Figure 5:
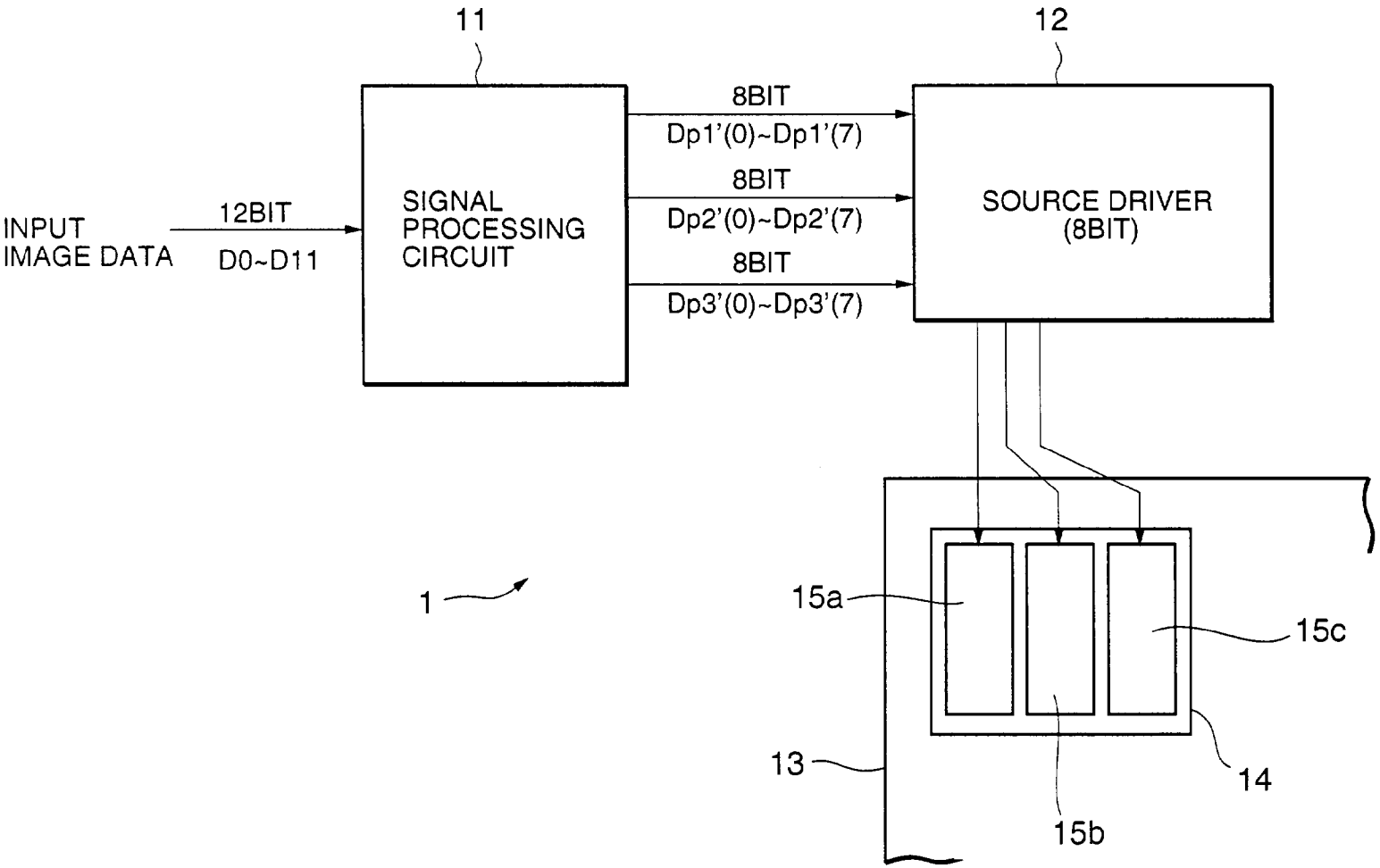
FIG. 5 is a block diagram of a first embodiment of the present invention.

FIG. 5 shows the image display device of the first embodiment of the present invention. In the case of this embodiment, the image display device is constituted as a LCD device 1.

In FIG. 5, the LCD device 1 of the first embodiment is constituted by a signal processing circuit 11, a source driver 12 and a LCD panel 13. The signal processing circuit 11 receives 12-bit (K=12) input image data values D0 to D11 and applies a predetermined signal processing to the data values D0 to D11. The source driver 12 drives the LCD panel 13 in accordance with a signal of 8-bit (J=8). The LCD panel 13 displays a desired image on a screen (not illustrated) in accordance with a driving signal supplied from the source driver 12.

Though a plurality of pixels 14 are arrange on the LCD panel 13 like a matrix, only one pixel 14 is displayed in FIG. 5 for simplification. Each pixel 14 is constituted by three (P=3) sub-pixels 15*a*, 15*b* and 15*c*.

The source driver 12 drives the pixels 14 on the LCD panel 13 in accordance with three 8-bit (J=8) data values Dp1' (0) to Dp1' (7), Dp2' (0) to Dp2' (7) and Dp3' (0) to Dp3' (7) (hereafter referred to as Dp1', Dp2' and Dp3') to display a desired image.

The signal processing circuit 11 distributes the 12-bit input image data values D0 to D11 to "time-shared frame data values" obtained by generating six (M=6) frames each of which includes three 8-bit data values in time series to supply the time-shared frame data to the source driver 12. The six frames arranged in time series constitute one "frame cycle", in other words, six frames are included in one "frame cycle".

Figure 6:
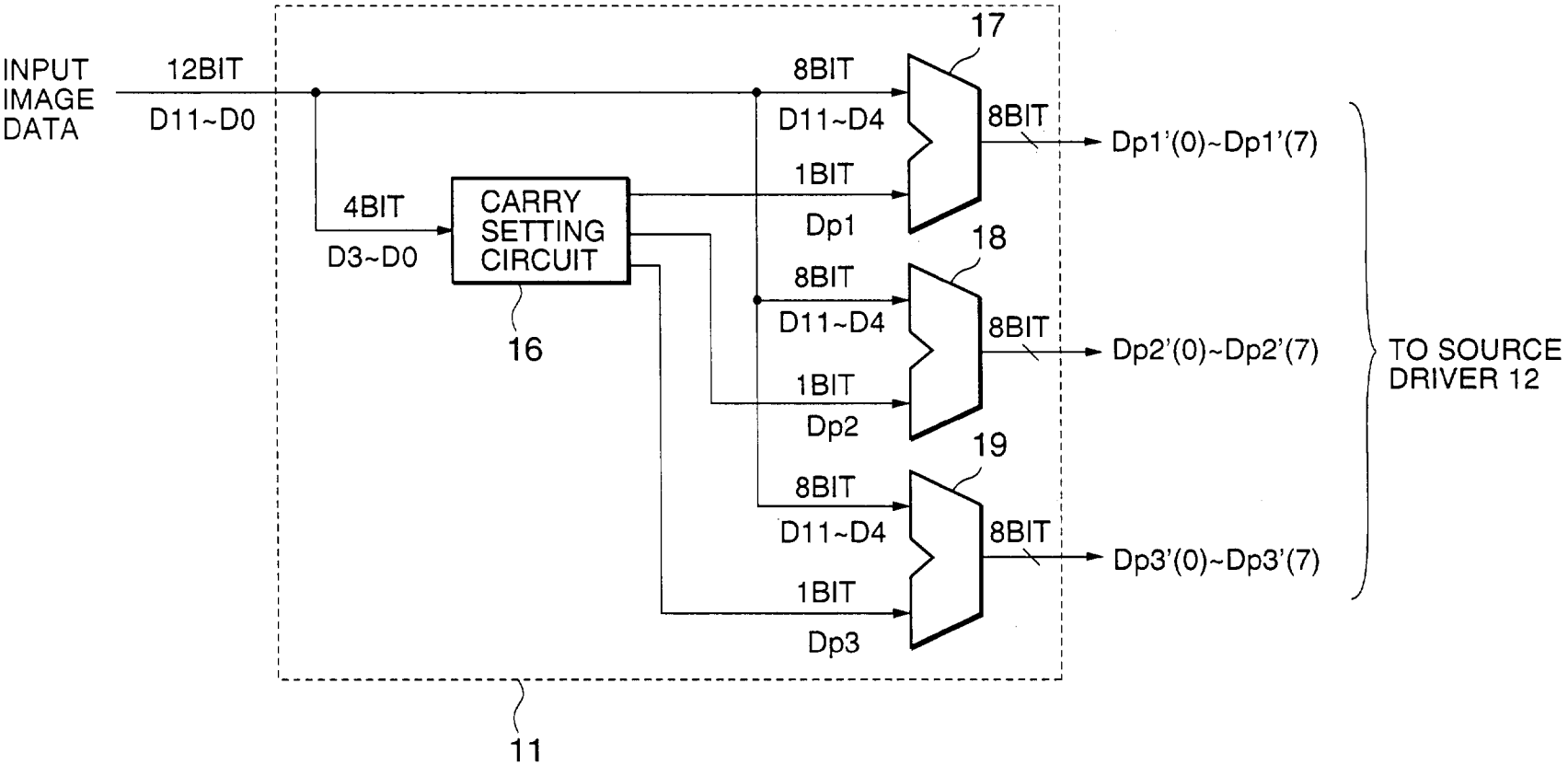
FIG. 6 is a more-specific block diagram of a signal processing circuit of the first embodiment of the present invention.

FIG. 6 shows a more specific block diagram of the signal processing circuit 11. In FIG. 6, the signal processing circuit 11 is constituted by one carry setting circuit 16 and three adders 17, 18 and 19.

The carry setting circuit 16 generates six time-series data values respectively for the sub-pixels 15*a*, 15*b* and 15*c* in time series in accordance with low-order 4-bit data values D3 to D0 of the 12-bit input image data values D0 to D11 to output the six time-series data values to the adders 17, 18 and 19 as carry signals Dp1, Dp2 and Dp3 for the sub-pixels 15*a*, 15*b* and 15*c*. The low-order 4-bit data values D3 to D0 of the input image data values D0 to D11 are divided because the difference N between the number of bits K of the input image data values D0 to D11 and the number of bits J of the source driver 12 is equal to 4 (K−J=N=4).

Each of the adders 17, 18 and 19 adds data values D11 to D4 of high-order 8 bits (J=8) of the input image data values D0 to D11 to six carry signals Dp1, Dp2 or Dp3 which are supplied in time-shared and outputs the addition results to the source driver 12 as 8-bit data values Dp1', Dp2' and Dp3' to each of the sub-pixels 15*a*, 15*b* and 15*c*.

The LCD device 1 of the first embodiment expresses halftones by the signal processing circuit 11 having the above configuration in accordance with the FRC gray level method. That is, display of 16 ($2^N=2^4=16$) gray levels insufficient due to the bit difference 4 (N=K−J=4) between the 12-bit (K=12) input image data values D0 to D11 and three 8-bit (J=8) data values Dp1', Dp2' and Dp3' supplied to the source driver 12 is realized through time-shared control by using 16 ways of combination among 3×6=18 ways of combinations generated in accordance with 6 "time-shared frame data values" and 3 sub-pixels of a pixel 14 of the liquid-crystal panel 13. Thus, it is possible to control the number of frames during a frame cycle in the FRC gray level method to 6 which is less than 16. As a result, it is possible to effectively avoid flicker or image unevenness.

Then, operations of the signal processing circuit 11, that is, operations for distributing 12-bit input image data values D0 to D11 to 6 time-shared frame data values are specifically described below.

In this case, FIG. 7 is a functional illustration for explaining relations between inputs and outputs of the carry setting circuit 16 and FIG. 8 is an illustration showing the time transition of the output data values (that is, carry signals Dp1, Dp2 and Dp3 of the carry setting circuit 16 every frame cycle.

The signal processing circuit 11 generates the carry signals Dp1, Dp2 and Dp3 for the sub-pixels 15*a*, 15*b* and 15*c* in which one frame cycle includes 6 time-shared data values in time-series in accordance with the low-order 4-bit data values D3 to D0 of the 12-bit input image data by the carry setting circuit 16. Then, the circuit 11 inputs the carry signals Dp1, Dp2 and Dp3 to the adders 17, 18 and 19 to add the signals to the data values D11 to D4 of high-order 8 bits of the 12-bit input image data. Thus, 6 frames respectively having 8-bit data values Dp1', Dp2' and Dp3' are generated to the sub-pixels 15*a*, 15*b* and 15*c* in time series. That is, 12-bit input image data values D11 to D0 are distributed to six 8-bit time-shared frame data values.

Low-order 4-bit data values D3 to D0 of the input image data are input to the carry setting circuit 16. There are 16 ways (0, 0, 0, 0) to (1, 1, 1, 1) for combinations of these data values D3 to D0. It is necessary to set 6 time-series data values to the time-series pattern of each frame every frame cycle as the carry signals Dp1, Dp2 and Dp3 to be output.

However, though the carry signals Dp1, Dp2 and Dp3 are generated as 6 time-series data values every frame cycle, time-series patterns which can be obtained are 6/6, 5/6, 4/6, 3/6, 2/6, 1/6 and 0/6 as shown in FIG. 8. In this case, the notation [A/B] denotes that "1" is output by A frames and "0" is output by (B−A) frames during one frame cycle (the total number of frames is equal to B). For example, in case of the time-series pattern (2/6), one frame cycle is constituted by 6 frames so that one cycle is completed by 6 frames to output "1" by the first frame, "0" by the second frame, "0"

by the third frame, "1" by the fourth frame, "0" by the fifth frame and "0" by the sixth frame.

Therefore, when time-series patterns are assigned so that a period in which the carry signals Dp1, Dp2 and Dp3 become "1" from the bit pattern (0, 0, 0, 0) toward the bit pattern (1, 1, 1, 1) increases, relations between inputs and outputs of the carry setting circuit 16 are shown in FIG. 7.

For example, when the low-order 4-bit data values D3 to D0 of the input image data are shown as (1, 0, 0, 0), the carry signals Dp1, Dp2 and Dp3 becomes the following. That is, the carry signal Dp1 outputs "1" by 4 frames among 6 frames and "0" by 2 frames. Moreover, the carry signal Dp2 outputs "1" by 3 frames among 6 frames and "0" by remaining 3 frames. The carry signal Dp3 outputs "1" by 3 frames among 6 frames and "0" by remaining 3 frames.

The adder 17 adds the carry signal Dp1 supplied from the carry setting circuit 16 to least significant bit (LSB) "D4" of the high-order 8-bit data values D11 to D4 of the input image data to output 8-bit data values Dp1' (0) to Dp1' (7) to be written in the sub-pixel 15*a*. Similarly, the adder 18 adds the carry signal Dp2 to the LSB "D4" of the high-order 8-bit data values D11 to D4 of the input image data to output the 8-bit data values Dp2' (0) to Dp2' (7) to be written in the sub-pixel 15*b*. The adder 19 adds the carry signal Dp3 to the LSB "D4" of the high-order 8-bit data values D3' (0) to Dp3' (7) of the input image data to output 8-bit data values Dp3' (0) to Dp3' (7) to be written in the third sub-pixel 15*c*.

Thus, the 8-bit data values Dp1' Dp2' and Dp3' for every sub-pixels 15*a*, 15*b*, and 15*c* generated by the signal processing circuit 11 are supplied to the source driver 12. The source driver 12 generates driving signals (analog signals) according to the 8-bit data values Dp1', Dp2' and Dp3' for every sub-pixels 15*a*, 15*b* and 15*c* and images corresponding to the 8-bit data values Dp1, Dp2 and Dp3 are displayed by the sub-pixels 15*a*, 15*b* and 15*c*.

For example, when the 12-bit input image data values D0 to D11 are set to (0, 0, 0, 0, 0, 0, 0, 0, 1, 0, 0, 0), the carry signals Dp1, Dp2, and Dp3 are converted into time-series patterns 4/6, 3/6 and 3/6 respectively by the carry setting circuit 16. The brightness expressions of the patterns 4/6, 3/6, and 3/6 become (10/18) (=(4+3+3)/(3×6)) when assuming that the brightness expression as 1 when input image data values D0 to D11 are set to (0, 0, 0, 0, 0, 0, 0, 1, 0, 0, 0, 0).

In FIG. 7, a brightness expression is added to the right end of each of the time-series patterns of the carry signals Dp1, Dp2 and Dp3 of 16 ways generated by the carry setting circuit 16.

Thus, the 12-bit input image data values D0 to D11 are constituted by 6 frames generated in time series and the frames are distributed to "time-shared data values" including the 8-bit data values Dp1', Dp2' and Dp3' for every sub-pixels 15*a*, 15*b*, and 15*c*. Moreover, images corresponding to these data values are displayed by the 8-bit source driver 12 and sub-pixels 15*a*, 15*b* and 15*c*.

As described above, in case of the LCD device 1 of the first embodiment, a plurality of pixels 14 respectively constituted by three sub-pixels 15*a*, 15*b* and 15*c* are arranged on the LCD panel 13 and the source driver 12 display-drives the pixels 14 of the LCD panel 13 in accordance with three 8-bit data values corresponding to the sub-pixels 15*a*, 15*b* and 15*c*. In this case, the 12-bit input image data values D0 to D11 are distributed to "time-shared frame data values" obtained by generating 6 frames respectively constituted by a combination of three 8-bit data values in time series and the three 8-bit data values are supplied to the source driver 12 in time-series.

Thus, $2^N$ (=16) gray levels insufficient due to the difference N (=4) between the numbers of bits of the 12-bit input image data and 8-bit source-driver driving data is realized through time-shared control using 16 ways among 3×6=18 ways of combinations performed in accordance with 6 time-shared frame data values.

As a result, it is possible to express gray levels (4,096, gray levels) corresponding to 12 bits of the input image data values D0 to D11 by the 8-bit source driver (256-gray level expression) 12 and decrease the total number of frames during one frame cycle to 6 which is less than the conventional number of frames. Therefore, it is prevented that the frame cycle is as ever lengthened as the number-of-bit difference N increases and the image quality is deteriorated due to flicker or image unevenness peculiar to the FRC gray level method.

Figure 20:
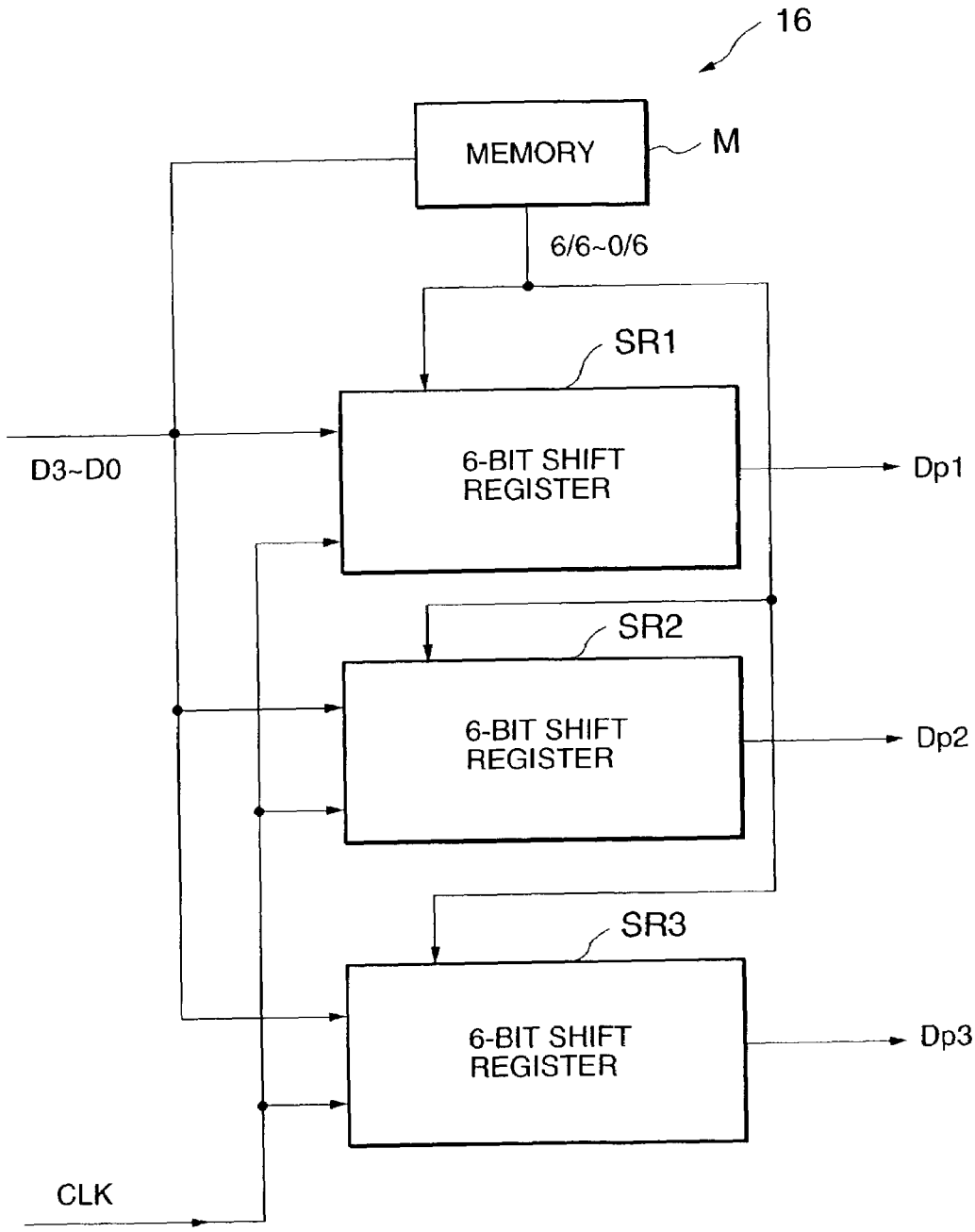
FIG. 20 is an illustration showing a configuration of the carry setting circuit of the first embodiment of the present invention.

FIG. 20 shows a specific configuration of the carry setting circuit 16 of the signal processing circuit 11.

The configuration in FIG. 20 includes one memory M and three 6-bit shift registers SR1, SR2 and SR3. The memory M previously stores the relations between inputs and outputs of the carry setting circuit 16 shown in FIG. 7. That is, time-series patterns (refer to FIG. 8) of the carry signals Dp1, Dp2 and Dp3 corresponding to the data D3 to D0 for low-order 4 bits of the input image data is stored as initialization values (6-bit data) to the 6-bit shift registers SR1 , SR2 and SR3 . Then, these initialization values are set to the shift registers SR1, SR2 and SR3 respectively in accordance with an input and then, 6 time-series data values Dp1, Dp2 and Dp3 are output from the shift registers SR1, SR2 and SR3 respectively every frame cycle in accordance with a clock CLK ticking a frame.

It is needless to say that the carry setting circuit 16 can be realized by a configuration other than that in FIG. 20.

[Second Embodiment]

Then, an image display device of a second embodiment of the present invention is described below. The hardware configuration of the image display device of this embodiment is the same as that of the LCD device 1 shown in FIGS. 5 and 6.

The second embodiment expresses halftones by using the FRC gray level method same as the first embodiment. However, the second embodiment is different from the first embodiment in that 16-gray level display insufficient due to the bit difference 4 between the numbers of bits of 12-bit input image data values D0 to D11 and three 8-bit data values Dp1', Dp2' and Dp3' supplied to the source driver 12 is performed through time-shared control for supplying five time-shared frame data values to each pixel 14 of the LCD panel 13. That is, the former embodiment is different from the latter embodiment (total number of frames is 6) only in that the total number of frames during one frame cycle is 5.

Thus, the configuration in FIGS. 5 and 6 is different from the first embodiment only in function of the carry setting circuit 16 in the signal processing circuit 11. Therefore, operations of the signal processing circuit 11 for distributing 12-bit input image data values D0 to D11 to five time-shared frame data values are described below by referring to FIGS. 9 and 10 and other descriptions are omitted.

FIG. 9 is a functional illustration for explaining relations between inputs and outputs of the carry setting circuit 16 and FIG. 10 is an illustration showing the time transition of outputs (carry signals Dp1, Dp2 and Dp3) of the carry setting circuit 16 every frame cycle.

The signal processing circuit 11 of the second embodiment generates carry signals Dp1, Dp2 and Dp3 for sub-pixels 15*a*, 15*b* and 15*c* having five time-series data values for each frame cycle in accordance with low-order 4-bit data values D3 to D0 of 12-bit input image data by the carry setting circuit 16 in time series and adds these carry signals Dp1, Dp2 and Dp3 to high-order 8-bit data values D1 to D4 of the 12-bit input image data by adders 17, 18 and 19. Thus, the 12-bit input image data values D0 to D11 are distributed to "time-shared frame data values" including five frames generated in time series each of which has 8-bit data values Dp1', Dp2' and Dp3' for the sub-pixels 15*a*, 15*b* and 15*c*.

However, in case of the second embodiment, five time-shared data values are distributed to three sub-pixels 15*a*, 15*b* and 15*c*. Therefore, the total number of combinations becomes 3×5=15 ways but the necessary number of gray levels of $2^4$=16 is not satisfied. Therefore, the shortage is compensated by adding a group of 2×5=10 time-shared frame data values.

That is, in FIG. 9, it is necessary to set combinations of 15 ways according to five time-series data values and combination of one way according to ten time-series data values every frame cycle for combinations (16 ways) of low-order 4-bit data values D3 to D0 of the input image data as the carry signals Dp1, Dp2 , and Dp3 to be output.

Therefore, time-series patterns which can be taken by the carry signals Dp1, Dp2 and Dp3 are such seven ways as 5/5, 4/5, 3/5, 2/5, 1/5, 0/5 and 1/10.

The time-series pattern 1/10 is changed by assuming the frame cycle as 10. Moreover, the time-series pattern 1/10 becomes time-series data different from ten time-series data values generated by repeating five time-series data values two times (that is, by doubling the frame cycle) on other time-series patterns of six ways 5/5, 4/5, 3/5, 2/5, 1/5 and 0/5.

For example, when the 12-bit input image data values D0 to D11 are set to (0, 0, 0, 0, 0, 0, 0, 0, 0, 0, 0, 1), the carry signals Dp1, Dp2 and Dp3 are converted into time-series patterns 1/10, 0/5 and 0/5 by the carry setting circuit 16 and the brightness expression becomes (1/30) (=(1/2+0+0)/(3×5)) by assuming the brightness expression as 1 when input image data values D0 to D11 are set to (0, 0, 0, 0, 0, 0, 0, 1, 0, 0, 0, 0)

Thus, the 12-bit input image data values D0 to D11 have 8-bit data values Dp1' , Dp2' and Dp3' for sub-pixels 15*a*, 15*b* and 15*c* for one frame and are distributed to 5 or 10 time-shared frame data values in which 5 or 10 frames are generated in time series. Then, an image is displayed in accordance with the sub-pixels 15*a*, 15*b* and 15*c* by the 8-bit source driver 12.

As described above, in case of the LCD device 1 of the second embodiment, one pixel 14 is constituted by 3 sub-pixels 15*a*, 15*b* and 15*c* and 16 gray levels insufficient due to the number-of-bit difference N=4 are realized by time-shared control combinations of 3×5=15 ways by supplying five time-shared frame data values to three sub-pixels 15*a*, 15*b* and 15*c*. In this case, because the number of time-shared control combinations becomes insufficient by one gray level, a group of other 10 time-shared frame data values is added. Thus, 16 gray levels being insufficient can be realized by time-shared control combinations of 15+1=16 ways.

Because the added group of time-shared frame data values includes 10 time-shared frame data values, the frame cycle is doubled. However, because the probability for the gray levels to be displayed at the double frame cycle is 1/16, the influence, is small.

[Third Embodiment]

Figure 11:
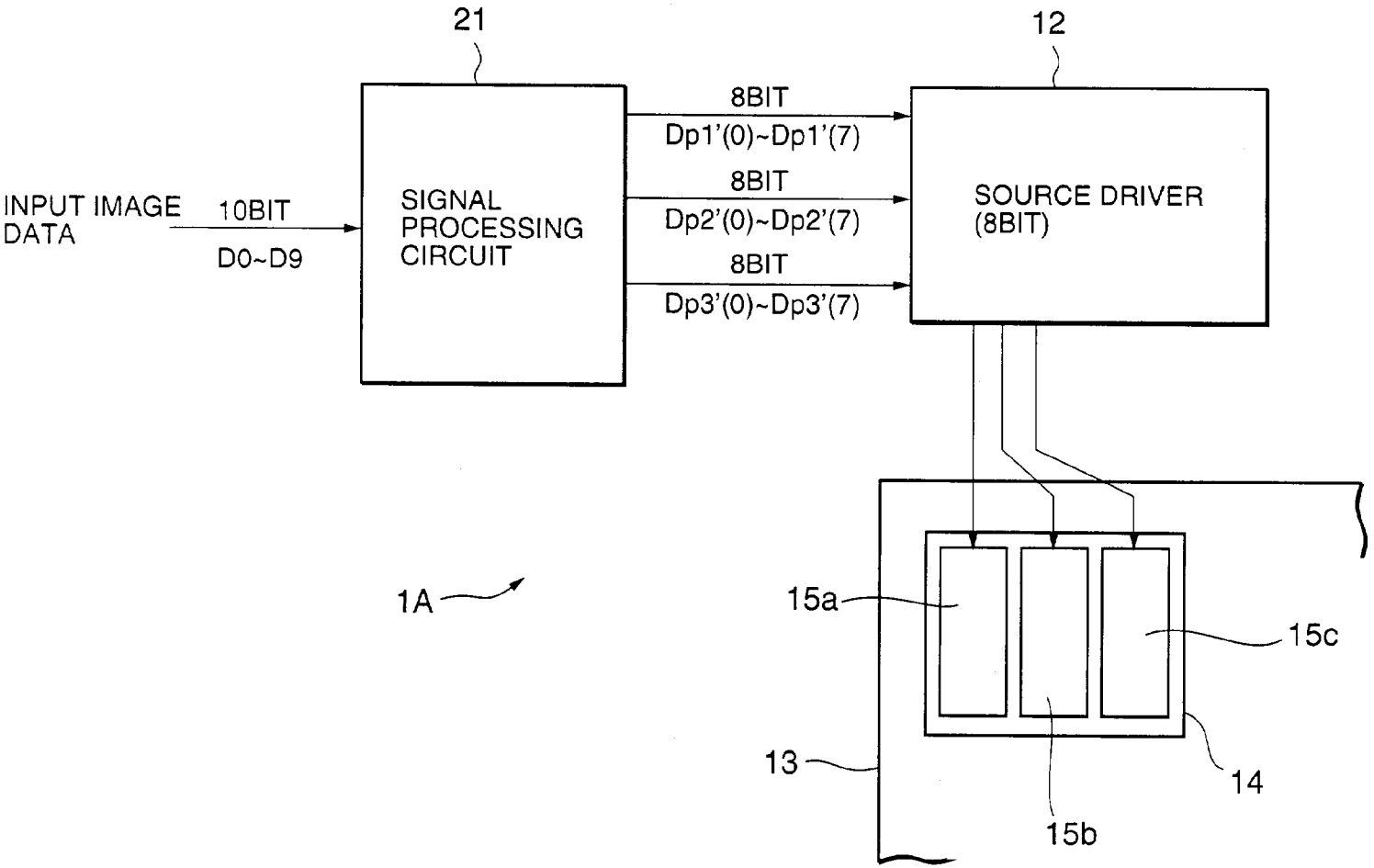
FIG. 11 is a block diagram of a LCD device of a third embodiment of the present invention.

FIG. 11 is a block diagram of a LCD device 1A of the third embodiment of the present invention. In FIG. 11, the LCD device 1A of this embodiment is constituted by a signal processing circuit 21 for applying signal processing to 10-bit (K=10) input image data values D0 to D9, an 8-bit source driver 12 and a LCD panel 13. That is, the LCD device 1A uses the LCD device 1 of the first embodiment in which the number of bits of input image data is changed to 10 bits and the signal processing circuit 21 corresponding to 10 bits is included.

The signal processing circuit 21 distributes the 10-bit input image data values D0 to D9 to "time-shared frame data values" having three 8-bit data values and including two (M=2) frame generated in time series and supplies the time-shared frame data values to the source driver 12.

Figure 12:
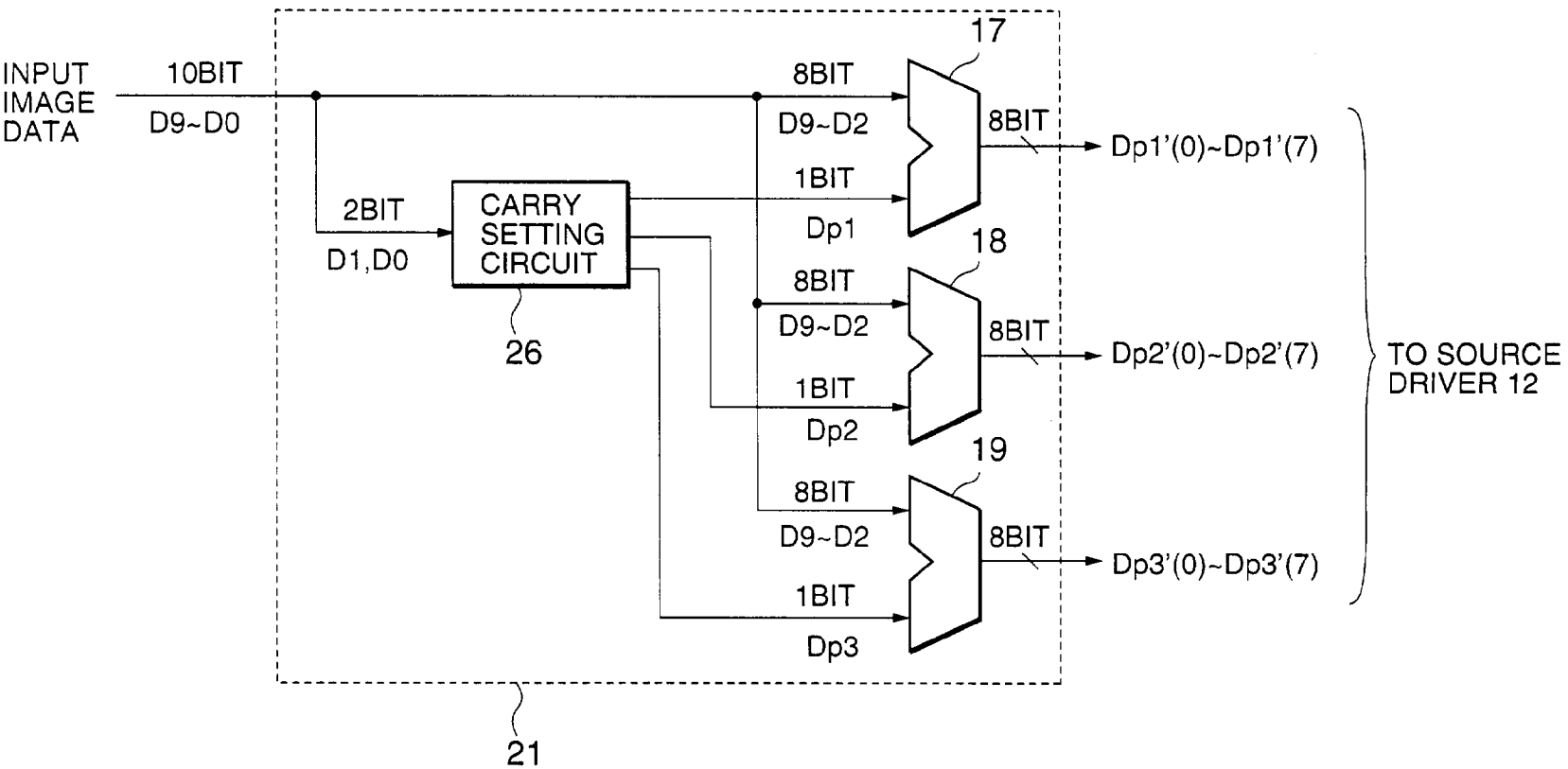
FIG. 12 is a more specific block diagram of a carry setting circuit of the third embodiment of the present invention.

FIG. 12 shows a more specific configuration of the signal processing circuit 21. In FIG. 12, the signal processing circuit 21 is constituted by one carry setting circuit 26 and three adders 17, 18 and 19.

The carry setting circuit 26 generates respectively two time-series data values for sub-pixels 15*a*, 15*b* and 15*c* in time-shared in accordance with low-order 2-bit data values D1 and D0 among 10-bit input image data values D0 to D9 and outputs the time-series data values to the three adders 17, 18 and 19 as carry signals Dp1, Dp2 and Dp3.

The adders 17, 18 and 19 add high-order 8-bit data values D9 to D2 of 10-bit input image data values D0 to D9 to respectively two carry signals Dp1 , Dp2 and Dp3 generated in time-shared and output the addition results to the source driver 12 as 8-bit Data values Dp1', Dp2' and Dp3' for the sub-pixels 15*a*, 15*b* and 15*c*.

Then, operations of the signal processing circuit 21 for distributing 10-bit input image data values D0 to D9 to two time-shared frame data values are specifically described below by referring to FIGS. 13 and 14. FIG. 13 is a functional illustration for explaining relations between inputs and outputs of the carry setting circuit 26 and FIG. 14 is an illustration showing the time transition of the outputs (carry signals Dp1, Dp2 and Dp3) of the carry setting circuit 26 every frame cycle.

The signal processing circuit 21 of the third embodiment generates the carry signals Dp1, Dp2 and Dp3 for the sub-pixels 15*a*, 15*b* and 15*c* having 2 time-series data values every frame cycle in accordance with the low-order 2-bit data values D1 and D0 of 10-bit input image data by the carry setting circuit 26 in time-shared and adds these carry signals Dp1, Dp2 and Dp3 to high-order 8-bit data values D9 to D2 of input image data by the adders 17, 18 and 19 respectively. Thus, the input image data values D0 to D9 are distributed to "time-shared frame data values" including two frames generated in time series and having 8-bit data values Dp1', Dp2' and Dp3' for each frame.

In FIG. 13, it is necessary to set combinations of 4 ways according to 2 time-series data values every frame cycle to combinations (4 ways) of low-order 2-bit data values D1 and D0 of input image data as carry signals Dp1, Dp2 and Dp3 to be output. Moreover, time-series patterns which can be taken by the carry signals Dp1, Dp2 and Dp3 are 3 ways of 2/2, 1/2 and 0/2 as shown in FIG. 14.

The adders 17, 18 and 19 respectively add the carry signals Dp1, Dp2 and Dp3 to LSB "D2" of the high-order 8-bit data values D9 to D2 of input image data and respectively output the 8-bit data values Dp1', Dp2' and Dp3' to be written in the sub-pixels 15*a*, 15*b* and 15*c*.

Thus, the 10-bit input image data values D0 to D9 are distributed to the "time-shared data values" and then supplied to the 8-bit source driver 12 and a corresponding image is displayed in accordance with the sub-pixels 15*a*, 15*b* and 15*c*.

As described above, the LCD device 1A of the third embodiment distributes 10-bit input image data to "time-shared frame data values" generated by 2 frames including three 8-bit data values by the signal processing circuit 21 when displaying 10-bit input image data values D0 to D9 (number-of-bit difference N=2) so as to supply three 8-bit data values to the source driver 12 in time-shared and realize four gray levels insufficient due to the difference between the numbers of bits of 10-bit input image data and 8-bit data by time-shared control using four ways out of the total number of combinations of 3×2=6 ways performed in accordance with 2 time-shared frame data values for each pixel 14 of the LCD panel 13.

Thereby, it is possible to express gray levels (1,024 gray levels) corresponding to 10 bits of input data by an 8-bit driver (256-gray level expression) Moreover, because the number of frames for one frame cycle is set to 2 which is less than conventional $2^N$, it is prevented that a frame cycle increases as ever as the number-of-bit difference N increases and image quality is deteriorated due to flicker or image unevenness peculiar to the FRC gray level method as ever.

[Fourth Embodiment]

Figure 15:
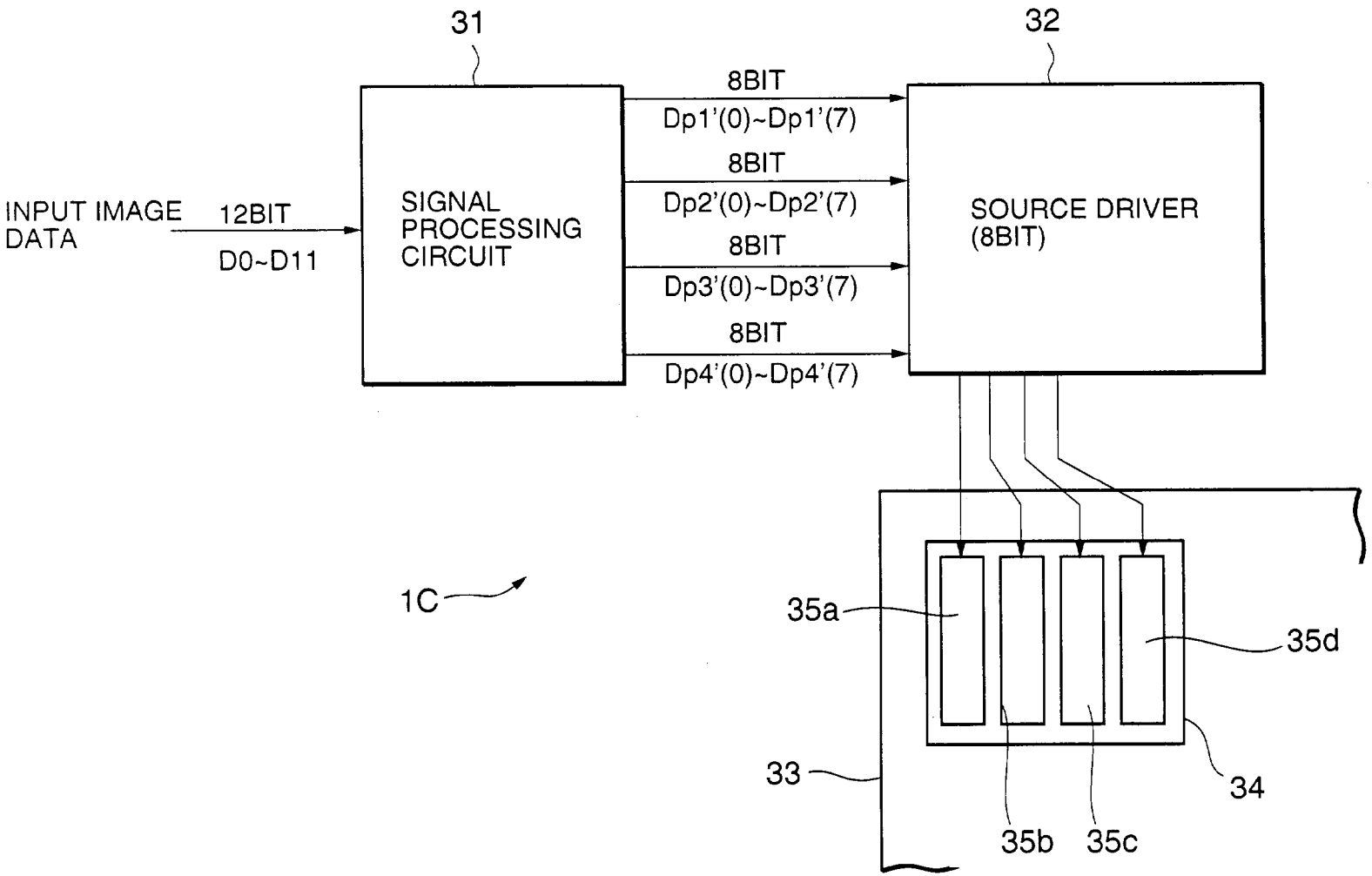
FIG. 15 is a block diagram of a LCD device of a fourth embodiment of the present invention.

FIG. 15 is a block diagram of a LCD device 1C of the fourth embodiment of the present invention. In FIG. 15, the LCD device of this embodiment is constituted by a signal processing circuit 31 for applying signal processing to 12-bit input image data values D0 to D11, an 8-bit source driver 32 and a LCD panel 33.

In this case, a plurality of pixels 34 are arranged on the LCD panel 33 and these pixels 34 respectively have four (P=4) sub-pixels 35*a*, 35*b*, 35*c* and 35*d*. Moreover, the source driver 32 display-drives the pixels 34 of the LCD panel 33 in accordance with four 8-bit (J=8) data values Dp1' (0) to Dp1' (7), Dp2' (0) to Dp2' (7), Dp3' (0) to Dp3' (7) and Dp4' (0) to Dp4' (7) (hereafter referred to as Dp1', Dp2', Dp3' and Dp4'). That is, the LCD device 1C uses the LCD device 1 of the first embodiment in which the number of sub-pixels of each pixel of the LCD panel 13 is set to 4 and the signal processing circuit 31 and source driver 32 corresponding to 4 sub-pixels of each pixel are included.

The signal processing circuit 31 distributes 12-bit input image data values D0 to D11 to "time-shared frame data values" including four (M=4) frames generated in time-series each of which includes three 8-bit data values to supply them to the source driver 32.

Figure 16:
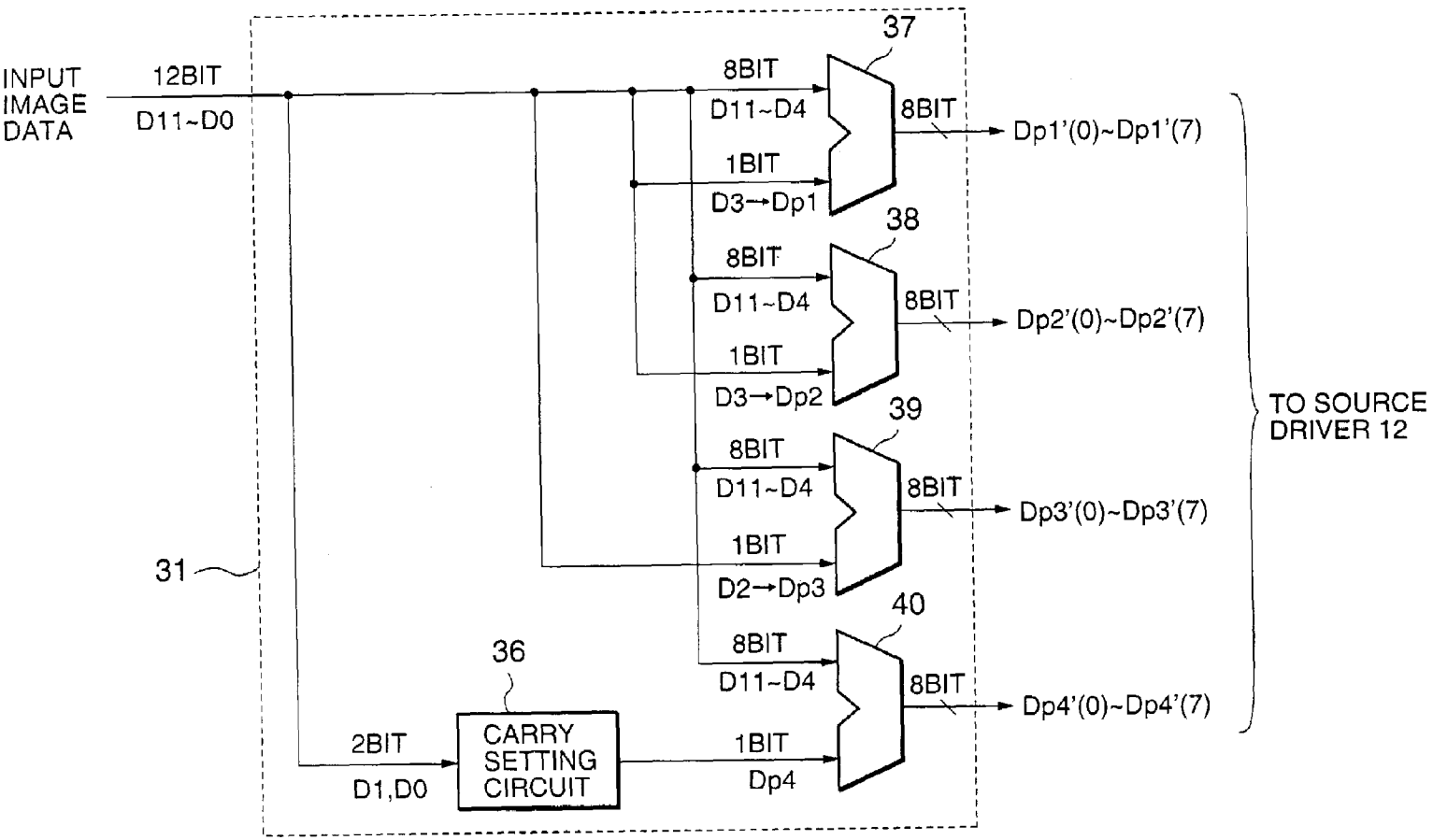
FIG. 16 is a more-specific block diagram of a signal processing circuit of the fourth embodiment of the present invention.

FIG. 16 shows a more specific configuration of the signal processing circuit 31. In FIG. 16, the signal processing circuit 31 is constituted by one carry setting circuit 36 and 4 adders 37, 38, 39 and 40.

The carry setting circuit 36 generates 4 time-series data values in time-shared in accordance with low-order 2-bit data values D1 and D0 of 12-bit input image data values D0 to D11 and outputs the time-series data values to the adder 40 as a carry signal Dp4.

The adders 37 and 38 respectively add maximum significant bit (MSB) "D3" of low-order 4-bit data to high-order 8-bit data values D11 to D4 of input image data values D0 to D11 as carry signals Dp1 and Dp2 and output the addition results to the source driver 32 as 8-bit data values Dp1' and Dp2' for the sub-pixels 35*a* and 35*b*. The adder 39 add second bit "D2" of low-order bit data to the high-order 8-bit data values D11 to D4 of the input image data values D0 to D11 as the carry signal Dp3 and outputs the addition result to the source driver 32 as 8-bit data value Dp3' for the sub-pixel 35*c*. The adder 40 adds the carry signal Dp4 to the high-order 8-bit data values D11 to D4 of the input image data values D0 to D11 and outputs the addition result to the source driver 32 as the 8-bit data value Dp4' for the sub-pixel 35*d*.

Then, operations of the signal processing circuit 31 are specifically described below by referring to FIGS. 17, 18 and 19. FIG. 17 is a functional illustration for explaining relations between inputs and outputs of the carry setting circuit 36. FIG. 18 is an illustration showing the time transition of the output (carry signal Dp4) of the carry setting circuit 36 for every frame cycle. FIG. 19 is an illustration for explaining relations between low-order 4-bit data values D3 to D0 of 12-bit input image data values D0 to D11 and carry signals Dp1 to Dp4.

The signal processing circuit 31 of the fourth embodiment generates the carry signal Dp4 for each sub-pixel having 4 time-series data values every frame cycle in time-shared in accordance with low-order 2-bit data values D1 and D0 of input image data by the carry setting circuit 36 and adds the carry signal Dp4 to high-order 8-bit data values D11 to D4 of 12-bit input image data by the adder 40 to generate the 8-bit data value Dp4' for the sub-pixel 35*d*. The adders 37 and 38 add MSB "D3" of the low-order 4-bit data to high-order 8-bit data values D11 to D4 of input image data respectively as carry signals Dp1 and Dp2 to generate 8-bit data values Dp1' and Dp2' for the sub-pixels 35*a* and 35. The adder 39 adds the second bit "D2" of the low-order 4-bit data to high-order 8-bit data values D11 to D4 of 12-bit input image data values D0 to D11 as the carry signal Dp3 to generate 8-bit data value Dp3' for the sub-pixel 35*c*. Thus, the 12-bit input image data values D0 to D11 are distributed to "time-shared frame data values" including four frames generated in time series each of which has 8-bit data values Dp1', Dp2', Dp3' and Dp4' for every sub-pixel.

First, operations of the carry setting circuit 36 are described below by referring to FIG. 17. It is necessary to set combinations of 4 ways according to 4 time-series data values to combinations (4 ways) of low-order 2-bit data values D1 and D0 of input image data every frame cycle as the carry signal Dp4 to be output. Moreover, time-series patterns which can be taken by the carry signal Dp4 are 4 ways of 3/4, 2/4, 1/4 and 0/4 as shown in FIG. 18.

In the case of the carry signals Dp1 , Dp2 and Dp3 , a time-series pattern is either of 4/4 and 0/4 because one bit (D3 or D3 and D2 respectively) of input image data is directly used.

The adders 37, 38, 39 and 40 respectively add carry signals Dp1, Dp2, Dp3 and Dp4 to LSB "D4" of high-order 8-bit data values D11 to D4 of input image data respectively and output 8-bit data values Dp1', Dp2', Dp3' and Dp4' to be written in the sub-pixels 35*a*, 35*b*, 35*c* and 35*d*.

Thus, 8-bit data values Dp1', Dp2', Dp3' and Dp4' for the sub-pixels 35*a*, 35*b*, 35*c* and 35*d* generated by the signal processing circuit 31 are supplied to the source driver 32. The source driver 32 generates driving signals (analog signals) based on 8-bit data values Dp1', Dp2', Dp3' and Dp4' every sub-pixels 35*a*, 35*b*, 35*c* and 35*d* and the sub-pixels 35*a*, 35*b*, 35*c* and 35*d* corresponding to the 8-bit data values Dp1', Dp2', Dp3' and Dp4' are displayed.

The above mentioned is more specifically described below by referring to FIG. 19. For example, when 12-bit input image data values D0 to D11 are set to (0, 0, 0, 0, 0, 0, 0, 0, 1, 0, 0, 0), the carry signal Dp4 serves as the time-series pattern 0/4 by the carry setting circuit 36. In this case, the input image data values D3 and D2 are set to (1,0)

(this represents that the carry signals Dp1 , Dp2 and Dp3 serve as time-series patterns 4/4, 4/4 and 0/4). Therefore, the brightness expression is shown as (8/16) (=(4+4+0+0/(4×4)) by assuming the brightness expression when the input image data values D0 to D11 are set to (0, 0, 0, 0, 0, 0, 0, 1, 0, 0, 0, 0) as 1.

In FIG. 19, brightness expressions corresponding to low-order 4-bit data values D3 to D0 of the 12-bit input image data values D0 to D11 are added to the right end.

Thus, the 12-bit input image data values D0 to D11 are distributed to "time-shared frame data values" having 8-bit data values Dp1', Dp2', Dp3' and Dp4' and an image is displayed in accordance with the sub-pixels 35*a*, 35*b*, 35*c* and 35*d* by the 8-bit source driver 32.

As described above, in case of the LCD device 1C of the fourth embodiment, a plurality of pixels 34 respectively constituted by four sub-pixels 35*a*, 35*b*, 35*c* and 35*d* are arranged on the LCD panel 33 and these pixels 34 are display-driven by the source driver 32 in accordance with 8-bit data values Dp1', Dp2', Dp3' and Dp4'. In this case, to display 12-bit input image data values D0 to D11 (number-of-bit difference N=4), 16 gray levels insufficient due to the number-of-bit difference 4 are realized in accordance with combinations of time-shared controls of 4×4=16 ways performed for each pixel 34 of the LCD panel 33 in accordance with "time-shared frame data values" by distributing the input image data values D0 to D11 to the "time-shared frame data values" by the signal processing circuit 31 and supplying four 8-bit data values to the source driver 32 in time-shared.

Thereby, gray levels (4,096 gray levels) corresponding to 12 bits of input data can be expressed by an 8-bit driver (256-gray level expression) and the number of frames for one frame cycle is set to 4 which is less than conventional $2^N$. Therefore, it is prevented that a frame cycle increases as ever as the number-of-bit difference N increases and image quality is deteriorated due to flicker or image unevenness peculiar to the FRC gray level method as ever.

For the above-described first, second, third and fourth embodiments, a LCD device provided with a LCD panel is described as a specific example. However, it is needless to say that the present invention can be applied to another flat-panel display device such as a plasma display device. Also in this case, advantages same as the case of the above embodiments can be obtained.

Moreover, the above embodiments are described independently of monochrome or color. However, the present invention can be applied to monochromatic and color display devices.

To use a color LCD panel, the first, second or third embodiment in which one pixel is divided into 3 sub-pixels is preferable for a panel in which color filter arrangement is stripe arrangement or delta arrangement and the fourth embodiment is preferable for a panel in which color filter arrangement is square arrangement.

As described above, according to an image display method and an image display device of the present invention, when expressing halftones by using the FRC gray level method, it is possible to control the number of frames during a frame cycle to $2^N$ or less when the difference between the number of bits of input image data and the number of bits of a driver is equal to N. As a result, it is possible to prevent flicker and image unevenness and preferably express halftones.

What is claimed is:

1. An image display method for expressing gray levels in accordance with a frame-rate-control (FRC) method using a display device having a plurality of pixels including P (P is a positive integer) sub-pixels, said method comprising:

supplying K-bit (K is positive integer) input image data to a signal processing circuit;

generating M (M is positive integer) time-shared frame data in time series each having P J-bit (J is positive integer of J<K and $M<2^{K-J}$) data from K-bit input image data; and supplying said time-shared frame data to a source driver as driving data, wherein said signal processing circuit generates $2^{K-J}$ gray levels insufficient due to a difference between numbers of bits of the K-bit input image data and the J-bit time-shared frame data by using at least some of combinations of said time-shared frame data of (P×M) ways performed for each of the pixels in accordance with the $2^{K-J}$ gray levels, and when a total number of combinations of (P×M) ways of the time-shared frame data to the P sub-pixels is less than $2^{K-J}$ gray levels, i.e., $P\times M<2^{K-J}$, a shortage is compensated by using at least some of (Q×M) {Q is a positive integer of $(Q\times M)<2^{K-J}$} time-shared frame data values.

2. The image display method according to claim 1, wherein P carry signals are generated by generating M time-series data in time-shared for each of the sub-pixels in accordance with low-order (K−J) bits of the K-bit input image data, the P carry signals are added to high-order J-bit data of the input image data, respectively, and obtained addition results are used as J-bit data to each of the P sub-pixels.

3. The image display method according to claim 1, wherein a combination of the time-shared frame data for the P sub-pixels is decided so that a maximum value or a minimum value of low-order (K−J)-bit data values of the input image data are related to a maximum brightness or a minimum brightness of a combined display of the P sub-pixels, respectively.

4. The image display method according to claim 2, wherein a combination of the time-shared frame data for the P sub-pixels is decided so that a maximum value or a minimum value of low-order (K−J)-bit data values of the input image data are related to a maximum brightness or a minimum brightness of a combined display of the P sub-pixels, respectively.

5. The image display method according to claim 1, wherein the (Q×M) time-shared frame data is different from the M time-shared frame data.

6. The image display method according to claim 5, wherein the (Q×M) time-shared frame data has a shorter unit frame data than that of the M time-shared frame data.

7. An image display device for expressing gray levels by using a Frame Rate Control (FRC) method, comprising:

a display panel having a plurality of pixels including P (P is a positive integer) sub-pixels;

a driver for display-driving each of the pixels of the display panel in accordance with P J-bit (J is a positive integer) driving data values corresponding to the P sub-pixels; and a signal processing circuit for distributing K-bit (K is a positive integer of K>J) input image data to time-shared frame data values including M (M is a positive integer of $M<2^{K-J}$) frames arranged in time series each of which includes P J-bit data values and supplying the time-shared frame data values to the driver as driving data, wherein said signal processing circuit generates $2^{K-J}$ gray levels insufficient due to a difference between numbers of bits of the K-bit input image data and the J-bit time-shared frame data by using at least some of combinations of said time-shared frame data of (P×M) ways performed for each of the pixels in accordance with the $2^{K-J}$ gray levels, and when a total number of combinations of (P×M) ways of the time-shared frame data to the P sub-pixels is less than $2^{K-J}$ gray levels, i.e., $P \times M < 2^{K-J}$, a shortage is compensated by using at least some of (Q×M) {Q is a positive integer of $(Q \times M) < 2^{K-J}$} time-shared frame data values.

8. The image display device according to claim 7, wherein the signal processing circuit comprises a carry setting circuit for generating P carry signals by generating M time-series data values for each of the sub-pixels in time-shared in accordance with low-order (K−J)-bit data of the K-bit input image data and P adders for respectively adding the P carry signals to high-order J-bit data of the input image data and outputting the obtained addition results to each of the P sub-pixels as J-bit data.

9. The image display device according to claim 7, wherein a combination of the time-shared frame data for the P sub-pixels is decided so that a maximum value or a minimum value of low-order (K−J)-bit data values of the input image data are related to a maximum brightness or a minimum brightness of a combined display of the P sub-pixels, respectively.

10. The image display device according to claim 8, wherein a combination of the time-shared frame data for die P sub-pixels is decided so that a maximum value or a minimum value of low-order (K−J)-bit data values of the input image data are related to a maximum brightness or a minimum brightness of a combined display of the P sub-pixels, respectively.

11. The image display method according to claim 7, wherein the (Q×M) time-shared frame data is different from the M time-shared frame data.

12. The image display method according to claim 11, wherein the (Q×M) time-shared frame data has a shorter unit frame data than that of the M time-shared frame data.

13. An image display method using Frame Rate Control (FRC) method of a display panel having a plurality of pixels, said method comprising:

supplying K-bit input image data (K is positive integer) for a pixel including P (P is a positive integer) sub-pixels to a signal processing circuit;

dividing said K-bit input image data into J-bit (J<K) driving image data and (K−J)-bit data;

forming M time-shared frame data for each of said P sub-pixels so that (P×M) combination data correspond to said (K−J)-bit data; and driving each of P sub-pixels M dines using based on said (K−J)-bit data to display $2^{K-J}$ ($2^{K-J} < P \times M$) gray levels for each J-bit driving image data having $2^{j}$ gray levels so that said pixel including P sub-pixels display $2^{K}$ gray levels, wherein, when a total number of combinations of (P×M) ways of the time-shared frame data to the P sub-pixels is less than $2^{K-J}$ gray levels, i.e., $P \times M < 2^{K-J}$, a shortage is compensated by using at least some of (Q×M) {Q is a positive integer of $(Q \times M) < 2^{K-J}$} time-shared frame data values.

14. The image display method according to claim 13, wherein P carry signals are generated by generating M time-series data in time-shared for each of the sub-pixels in accordance with low-order (K−J) bits of the K-bit input image data, the P carry signals are added to high-order J-bit data of the input image data respectively, and the obtained addition results are used as J-bit data to each of the P sub-pixels.

15. The image display method according to claim 13, wherein a combination of the time-shared frame data for the P sub-pixels is decided so that a maximum value or a minimum value of low-order (K−J)-bit data values of the input image data are related to a maximum brightness or a minimum brightness of a combined display of the P sub-pixels, respectively.

16. The image display method according to claim 14, wherein a combination of the time-shared frame data for the P sub-pixels is decided so that a maximum value or a minimum value of low-order (K−J)-bit data values of the input image data are related to a maximum brightness or a minimum brightness of a combined display of the P sub-pixels, respectively.

17. The image display method according to claim 13, wherein the (Q×M) time-shared frame data is different from the M time-shared frame data.

18. The image display method according to claim 17, wherein the (Q×M) time-shared frame data has a shorter unit frame data than tat of the M time-shared frame data.

* * * * *